US008162390B2

(12) United States Patent
Zhong

(10) Patent No.: US 8,162,390 B2
(45) Date of Patent: Apr. 24, 2012

(54) CHILD CHAIR

(75) Inventor: Zhi-Ren Zhong, Central (HK)

(73) Assignee: Wonderland Nurserygoods Company Limited, Central (HK)

( * ) Notice: Subject to any disclaimer, the term of this patent is extended or adjusted under 35 U.S.C. 154(b) by 61 days.

(21) Appl. No.: 12/727,222

(22) Filed: Mar. 18, 2010

(65) Prior Publication Data

US 2011/0074186 A1 Mar. 31, 2011

(30) Foreign Application Priority Data

Sep. 30, 2009 (CN) ..... 2009 1 0179582

(51) Int. Cl.
*A47C 13/00* (2006.01)

(52) U.S. Cl. ..... 297/130

(58) Field of Classification Search ..... 297/130, 297/188.11, 188.13, 188.08, 440.22, 440.1, 297/440.24, 250.1, 256.16; 248/408
See application file for complete search history.

(56) References Cited

U.S. PATENT DOCUMENTS

| | | | | | |
|---|---|---|---|---|---|
| 1,739,366 | A * | 12/1929 | Lang | 297/37 |
| 1,967,533 | A * | 7/1934 | Koop | 297/183.5 |
| 2,560,708 | A * | 7/1951 | Titus | 297/153 |
| 2,731,072 | A * | 1/1956 | Post | 297/6 |
| 2,919,748 | A * | 1/1960 | Alden, Sr. | 297/153 |
| 3,512,833 | A * | 5/1970 | Sugiura | 297/410 |
| 4,938,603 | A * | 7/1990 | Turner et al. | 297/16.1 |
| 5,183,311 | A * | 2/1993 | Meeker et al. | 297/151 |
| 5,806,922 | A * | 9/1998 | Mendelovich | 297/130 |
| 5,951,102 | A | 9/1999 | Poulson | |
| 6,343,837 | B1 * | 2/2002 | Gage | 297/250.1 |
| 6,832,813 | B2 * | 12/2004 | Tomas et al. | 297/250.1 |
| 2002/0074835 | A1 * | 6/2002 | Chalender | 297/118 |
| 2006/0250005 | A1 | 11/2006 | Keegan | |

FOREIGN PATENT DOCUMENTS

| | | | |
|---|---|---|---|
| CN | 201055168 | Y | 5/2008 |
| CN | 201227066 | Y | 4/2009 |
| EP | 2 008 550 | A1 | 12/2008 |
| EP | 2 135 528 | A1 | 12/2009 |
| FR | 2 919 164 | | 1/2009 |
| GB | 464805 | | 4/1937 |

* cited by examiner

*Primary Examiner* — Milton Nelson, Jr.
(74) *Attorney, Agent, or Firm* — Winston Hsu; Scott Margo

(57) ABSTRACT

When a supporting frame is assembled to a seat, the child chair is used as a high chair. When the supporting frame is detached from the seat, the child chair may be served as a booster. The seat includes storages with straps connected. Each storage is covered with a cover selectively configured between a closed position and an opened position. When the supporting frame is detached from the seat, the covers may be moved to the opened position, covering coupling sections of the seat so that the supporting frame is not permitted to assemble to the seat; the straps are reachable outward the storages to secure the seat to an adult chair. When the straps are stored in the storages, the covers may be moved to the closed position, covering the storages and the coupling sections are exposed. The supporting frame is then permitted to assemble to the seat.

21 Claims, 11 Drawing Sheets

CHILD CHAIR

BACKGROUND OF THE INVENTION

1. Field of the Invention

The invention relates to a child chair, and more particularly, to a child chair capable of selectively configuring as a high chair or a booster.

2. Description of the Prior Art

Child chairs have been widely used for toddlers since they provide the toddlers roughly the same height as adult care givers such that the toddlers are easy to be taken care of or fed at the table. Although various structures embodied, child chairs usually do not have detachability between the seat and the supporting frame, leaving space-consuming drawback for themselves to store. Additionally, for the booster types of child chairs, straps are essential for securing the boosters at an adult chair. Such straps, however, do not properly store when unused, which may cause strangling accident to produce safety issue.

SUMMARY OF THE INVENTION

The invention provides a child chair that has a supporting frame detachably assembled to a seat, which incorporates strap storage function. When the supporting frame is detached from the seat, the strap may reach out of the seat for securing the seat to an adult chair and functions as a booster.

The invention provides a child chair that includes a seat, a supporting frame for detachably coupling with the seat, and a strap connecting to the seat. The child chair is convertible between a high chair status in which the supporting frame is coupled to the seat and a booster status in which the supporting frame is detached from the seat and the strap secures the seat to an adult chair.

The invention also provides a booster, which is capable of assembling to a supporting frame to form a high chair. The booster includes a seat and a strap. The seat has a coupling section and a storage. The coupling section is capable of detachably coupling with the supporting frame. The strap connects to the storage and is stored within the storage.

The invention also provides a child chair that includes a seat, a supporting frame, and a strap. The seat has a coupling section, a storage configured near the coupling section, and a movable cover. The supporting frame is used for detachably coupling with the coupling section. The strap is connected to the storage. The cover is moveable between a first position and a second position. When the cover moves to the first position, the cover covers the storage and the coupling section exposes for coupling with the supporting frame and the child chair is configured at a high chair status. When the cover moves to the second position, the cover covers the coupling section and the storage exposes and the strap is reachable outward the storage, and the child chair is configured at a booster status.

The child chair provided by the invention stores the straps in a safe way when the child chair is functioning as a high chair, and misuse of the straps can be prevented with incorporation of the detachable supporting frame and storage of the straps. Additionally, the detached supporting frame can be stored aside for reducing the packing size of the child chair.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
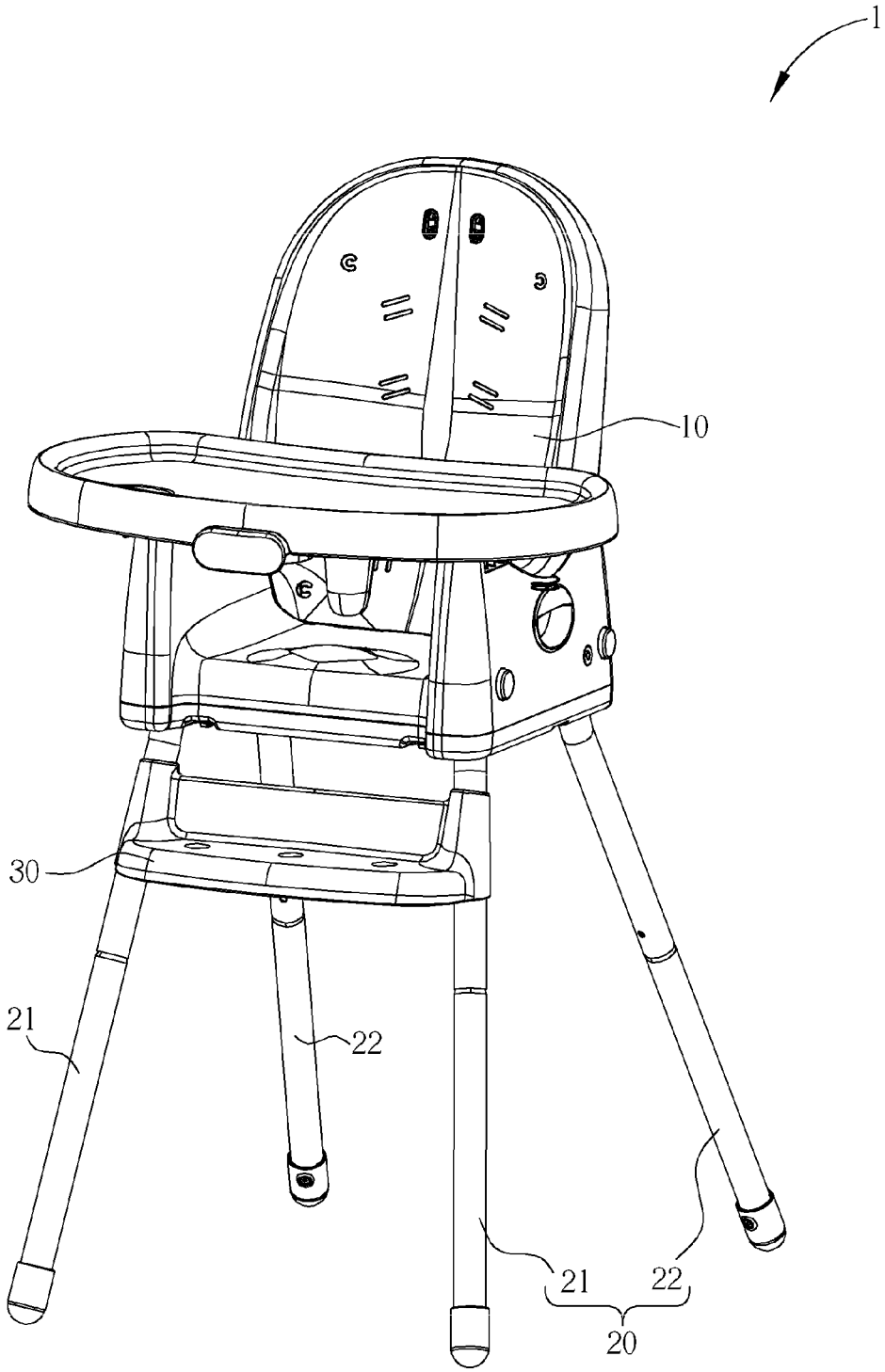
FIG. 1 is a schematic diagram of a child chair configured at a high chair status according to an embodiment of the invention.
Figure 2:
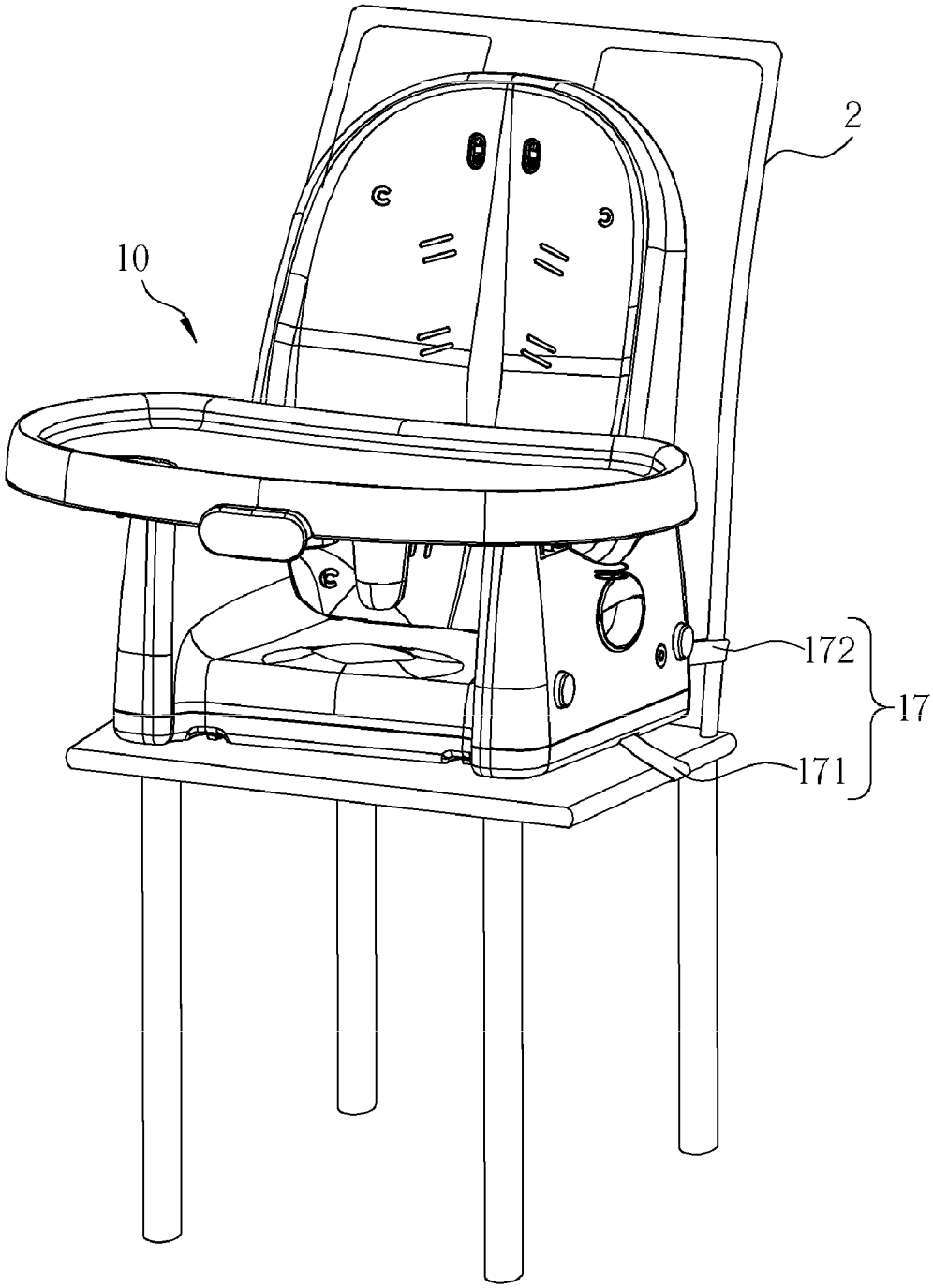
FIG. 2 is a schematic diagram of the child chair configured at a booster status.

Please refer to FIG. 1. FIG. 1 is a schematic diagram of a child chair 1 according to an embodiment of the invention. The child chair 1 includes a seat 10, a supporting frame 20, and a safety belt set 17 connecting to the bottom of the seat 10. The safety belt set 17 is alternatively shown in FIG. 2 and FIG. 7. In this embodiment, the supporting frame 20 includes two front legs 21 and two rear legs 22, which are detachably mounted to the bottom of the seat 10 such that the child chair 1 may be selectively configured at the status shown in FIG. 1 to function as a high chair, or a booster status shown in FIG. 2 after the supporting frame 20 is removed from the seat 10. FIG. 2 shows that the seat 10 is removed from the supporting frame 20 and placed on an adult chair 2. The safety belt set 17 of the child chair 1 may secure the seat 10 to the adult chair 2 such that the seat 10 works as a booster.

Figure 3:
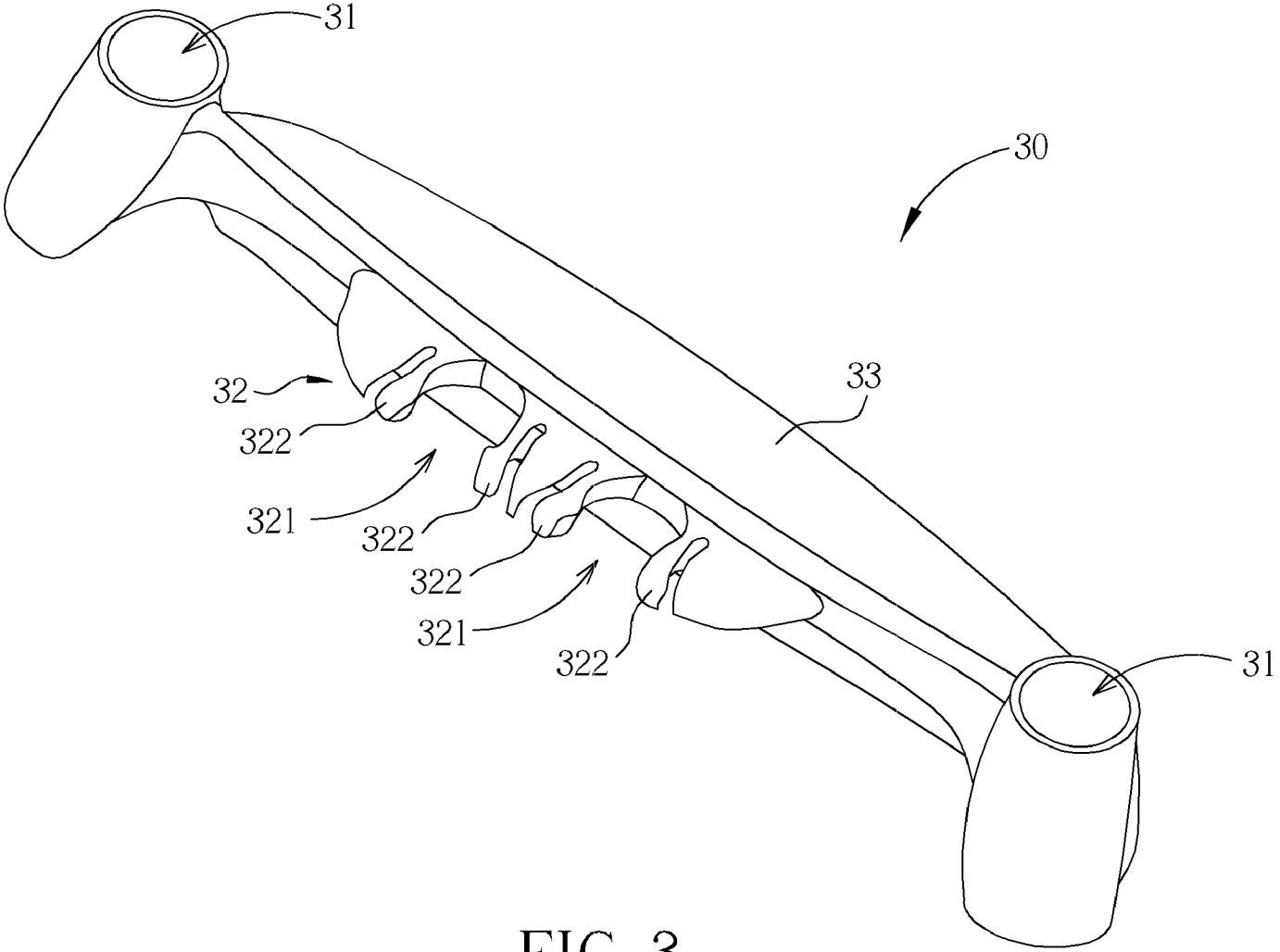
FIG. 3 is a schematic diagram of a footrest of the child chair.
Figure 4:
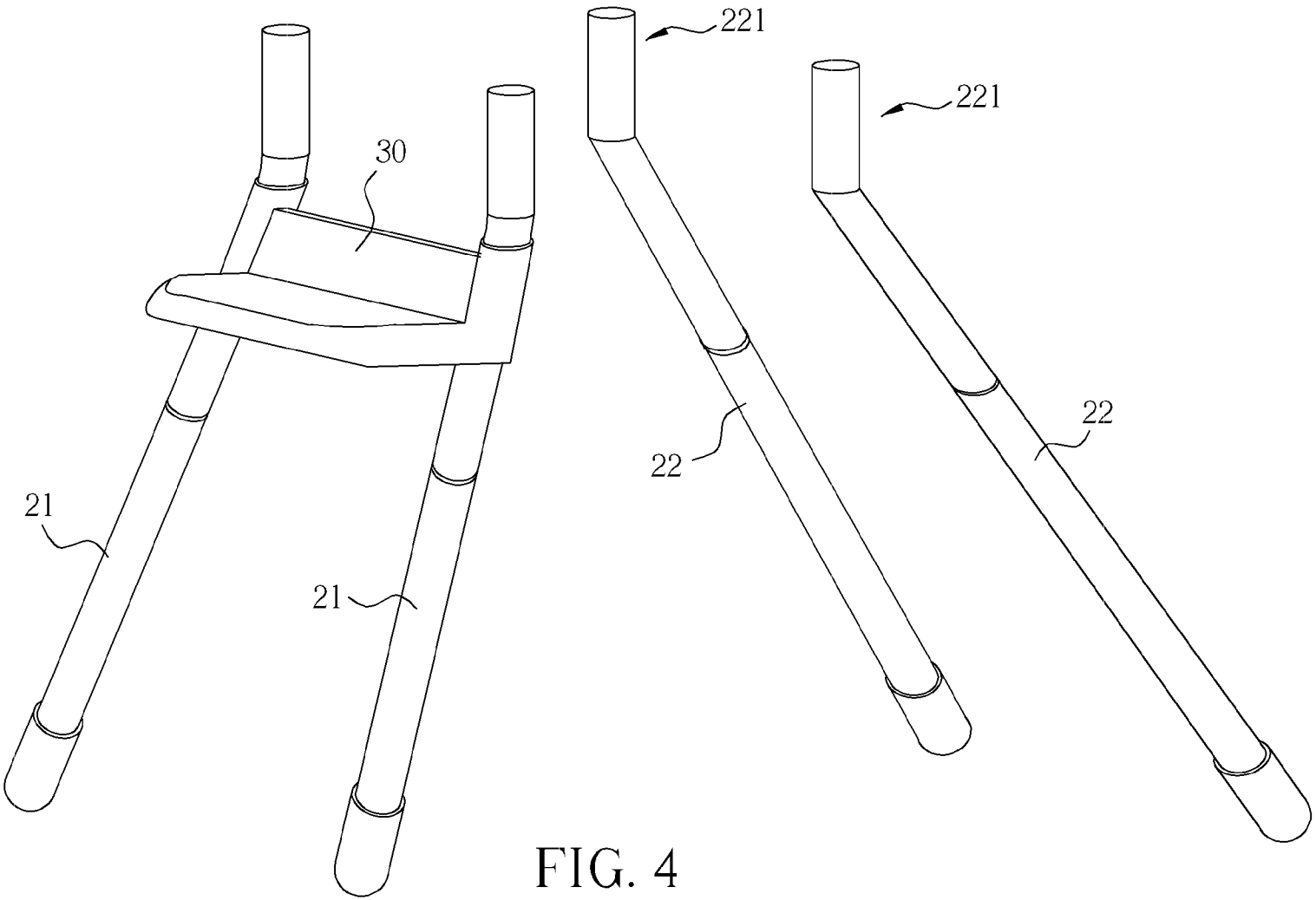
FIG. 4 is a schematic diagram of the footrest and a supporting frame of a first embodiment according to the invention.
Figure 9:
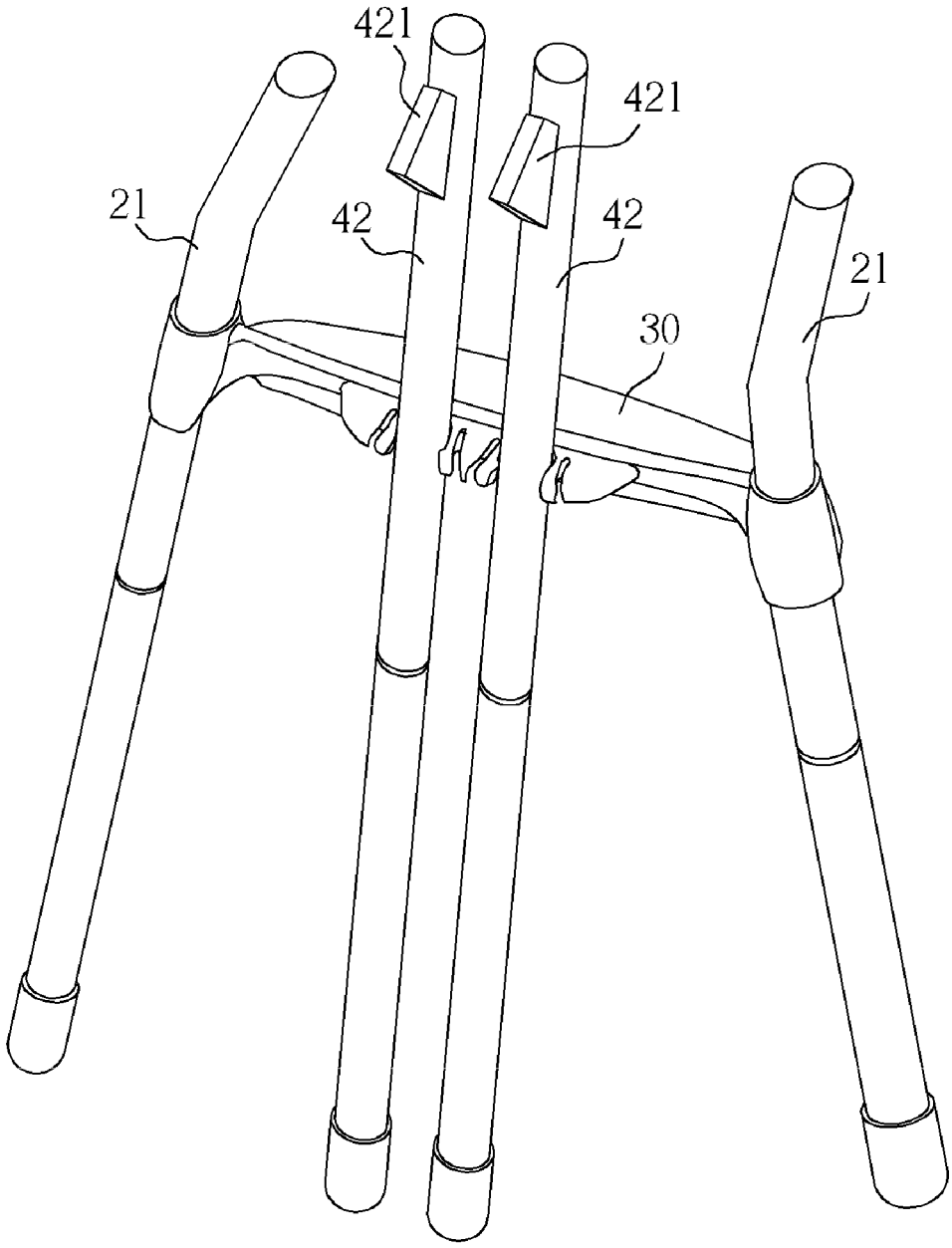
FIG. 9 is a schematic diagram of two rear legs coupling with the footrest in a second embodiment of the child chair.

The child chair 1 in this embodiment further includes a footrest 30 configured at the supporting frame 20. Please refer to FIG. 3 and FIG. 4. FIG. 3 is a schematic diagram of the footrest 30 and FIG. 4 is a schematic diagram of the footrest 30 and the supporting frame 20 of a first embodiment according to the invention. The footrest 30 includes a pedal body 33 and two through holes 31 locating at both sides of the pedal body 33. The pedal body 33 has a laterally oriented mounting section 32, which includes two coupling slots 321. The two front legs 21 are passed through the two through holes 31 of the footrest 30 respectively so as to mount the footrest 30 on the two front legs 21 of the supporting frame 20. In the first embodiment, both two rear legs 22 have a bending section 221 at the top end respectively, shown in FIG. 4. As the supporting frame 20 is detached from the seat 10, the two rear legs 22 may each couple to one of the coupling slots 321 of the mounting section 32 for storage convenience. The status of coupling between the footrest 30 and the support frame 20 may also be referred to another embodiment as shown in FIG. 9. Two resilient arms 322 are formed at the walls of both sides that define each coupling slot 321 and provide engagement for the rear legs 22. Nevertheless, the footrest 30 may also be omitted or mounted directly to the seat 10 in other embodiments of the invention.

Figure 5:
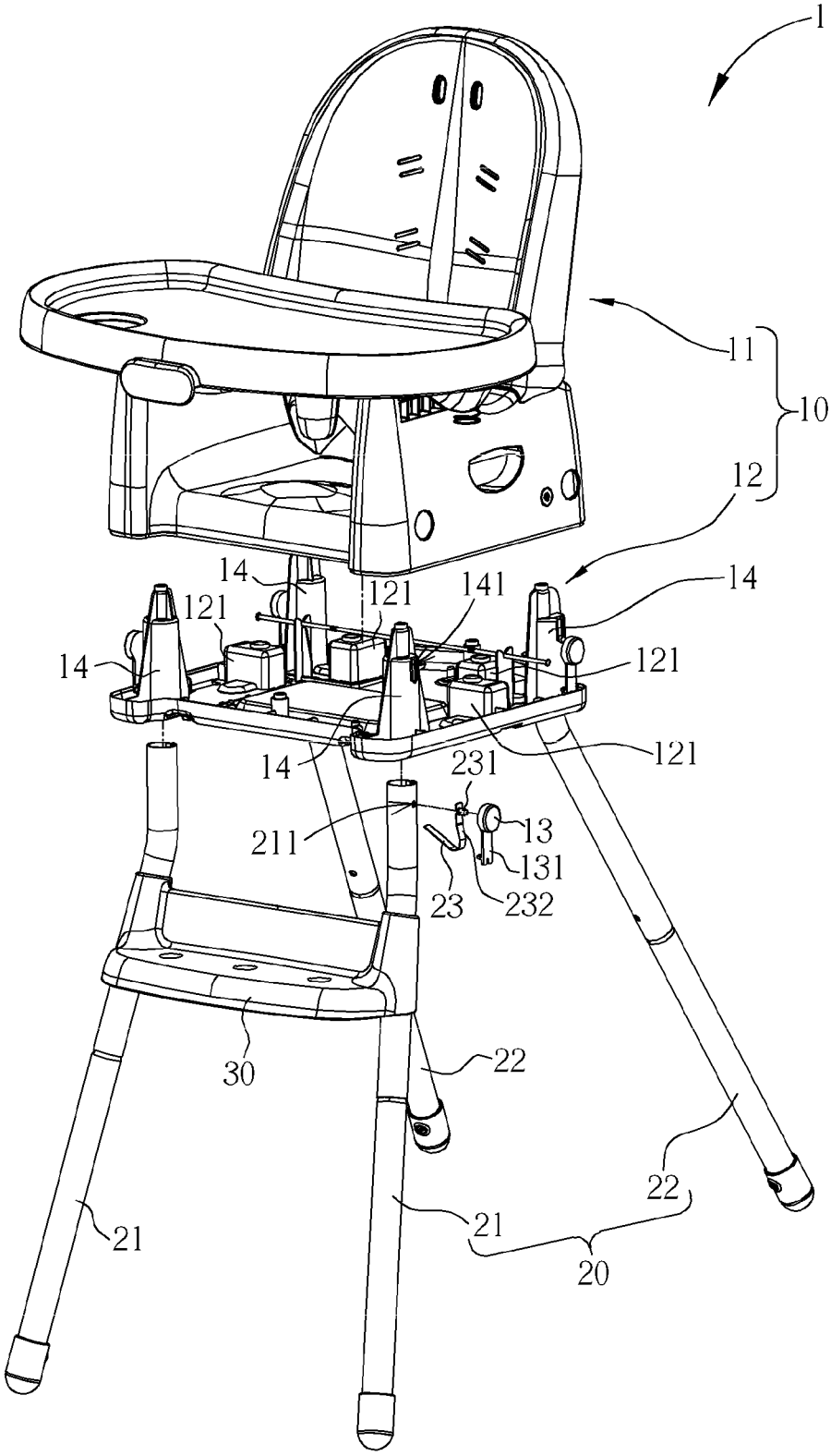
FIG. 5 is a schematic diagram showing each components of the child chair in an exploded view.
Figure 6:
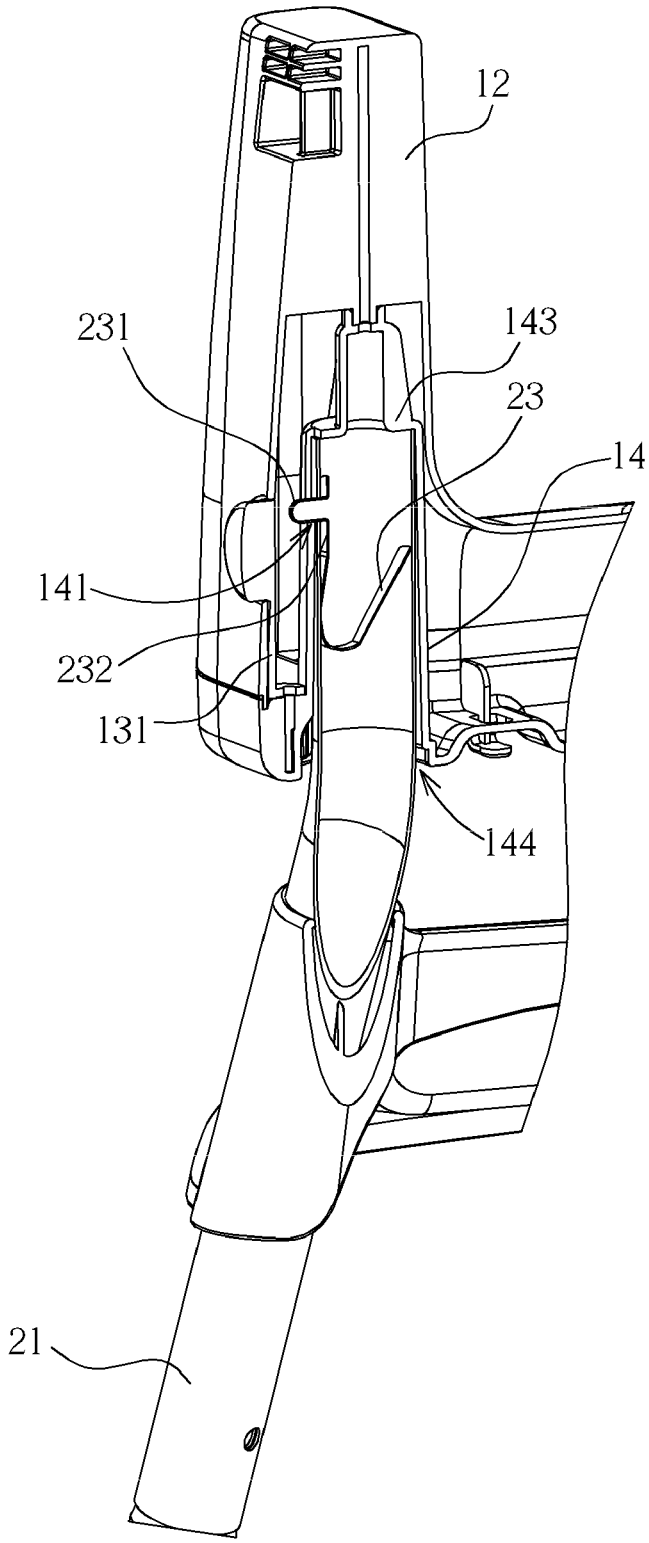
FIG. 6 is a schematic diagram of sectional view of part of the seat coupling with a front leg of the supporting frame.

Please refer to FIG. 5 and FIG. 6. FIG. 5 is a schematic diagram showing each components of the child chair 1 in an exploded view, and FIG. 6 is a schematic diagram of sectional view of part of the seat 10 coupled with a front leg 21, whereas the engagement of the seat 10 and the rear legs 22 is same as shown in FIG. 6 and is omitted here. Referring to FIG. 5, the seat 10 may be formed by assembling a body 11 and a base 12. The base 12 has a coupling section 14 for connecting with the supporting frame 20 and in this embodiment, the coupling section 14 includes a plurality of openings 144, whereas the front legs 21 and the rear legs 22 of the supporting frame 20 may insert their top end into each corresponding opening 144 such that the supporting frame 20 is connected to the coupling section 14 at the bottom of the seat 10 in a detachable way and the child chair 1 is configured at the high chair status as shown in FIG. 1. Since the bending section 221 of each rear leg 22 tilts in an angle with the rest section of the rear leg 22, both rear legs 22 has tilting angle relative to the seat 10 as the bending section 221 of each rear leg 22 connects with each corresponding opening 144. The rear legs 22 is then extended outward relative to the seat 10 to provide stronger support for the seat 10. As the supporting frame 20 is detached from the coupling section 14 as mentioned previously, the child chair 1 can be configured as the booster status as shown in FIG. 2.

To detach the supporting frame 20 from the coupling section 14, the supporting frame 20 may be hollow pipes in this embodiment, and each leg 21, 22 of the supporting frame 20 includes a fastening component 23 inside the pipe to secure the legs 21, 22 to the base 12 of the seat 10. Taking the front leg 21 for example, the fastening component 23 may be a V-shape resilient piece, with a protrusion 231 at one end of one of its arm 232. A first hole 211 locates at the wall of the pipe of the front leg 21 and a second hole 141 is formed at the wall that defines the corresponding opening 144. The arm 232 of the fastening component 23 abuts against the wall inside the front leg 21, with the protrusion 231 extending through the first hole 211. As the front leg 21 inserts into the corresponding opening 144 of the coupling section 14, the stop 143 of the base 12 is against the front leg 21, providing a supportive node for the front leg 21 to support the seat 10, and the protrusion 231 of the fastening component 23 further extends through the second hole 141 of the coupling section 14, hence securing the front leg 21 to the corresponding opening 144 of the coupling section 14. As a result, the fastening component 23 may be used to prevent the front leg 21 (or other legs 21, 22) from detaching from the corresponding opening 144 of the coupling section 14.

Moveable operating components 13, which may be buttons in this embodiment, are further mounted at the body 11 of the seat 10 and near the second hole 141 of each corresponding opening 144 of the coupling section 14. Through pressing each operating component 13, the corresponding protrusion 231 of the fastening component 23 may be disengaged from the corresponding second hole 141, thereby the corresponding front leg 21 detached from the corresponding opening 144. In this embodiment, the operating component 13 extends downwardly to form a resilient arm 131 that can restore the operating component 13 to its original position.

Though one front leg 21 coupling with corresponding opening 144 is used as disclosure in the previous paragraphs, the other front leg 21 and the rear legs 22 coupling with each corresponding opening 144 (and the way of detaching) has same mechanism and is omitted herein for brevity purpose.

In other embodiments of the invention, the base 12 may be a monolithic part of the body 11, instead of an individual component, while the front legs 21 and the rear legs 22 may have spiral top ends such that the legs 21, 22 may be screwed into corresponding spiral coupling section 14 to secure the supporting frame 20 to the bottom of the seat 10.

Figure 7:
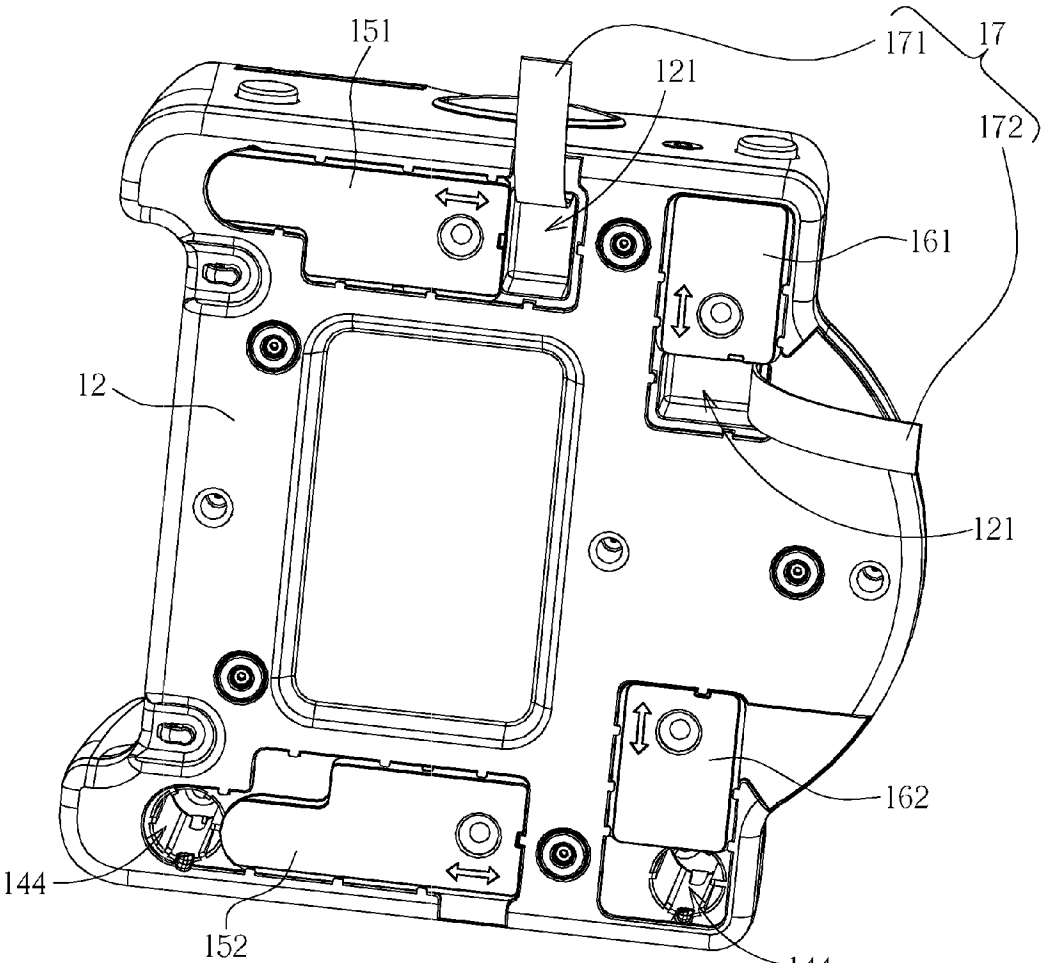
FIG. 7 is a schematic diagram showing the bottom of the seat of the first embodiment of the child chair according to the first embodiment of the invention.

Please keep referring to FIG. 5 and FIG. 7, where FIG. 7 is a schematic diagram showing the bottom of the seat 10 of the first embodiment of the child chair 1. The base 12 of the seat 10 further includes storages 121 for storing the safety belt set 17. The safety belt set 17 includes a first belt set 171 and a second belt set 172, each including two straps and configured at the sides of the base 12. Please refer to FIG. 2 together. The two straps of the first belt set 171 couple to each other under the adult chair 2, and the two straps of the second belt set 172 couple to each at the back of the adult chair 2 such that the seat 10 can be secured to the adult chair 2. Each strap of the safety belt set 17 connects to the wall of each storage 121. The seat 10 further includes a plurality of covers 151, 152, 161, 162 that are moveably connected to the bottom of the base 12 and each corresponds to one storage 121 and the opening 144 of the seat 10. The covers 151, 152, 161, 162 are moveable between an opening position and a closed position relative to the base 12 of the seat 10.

Figure 8:
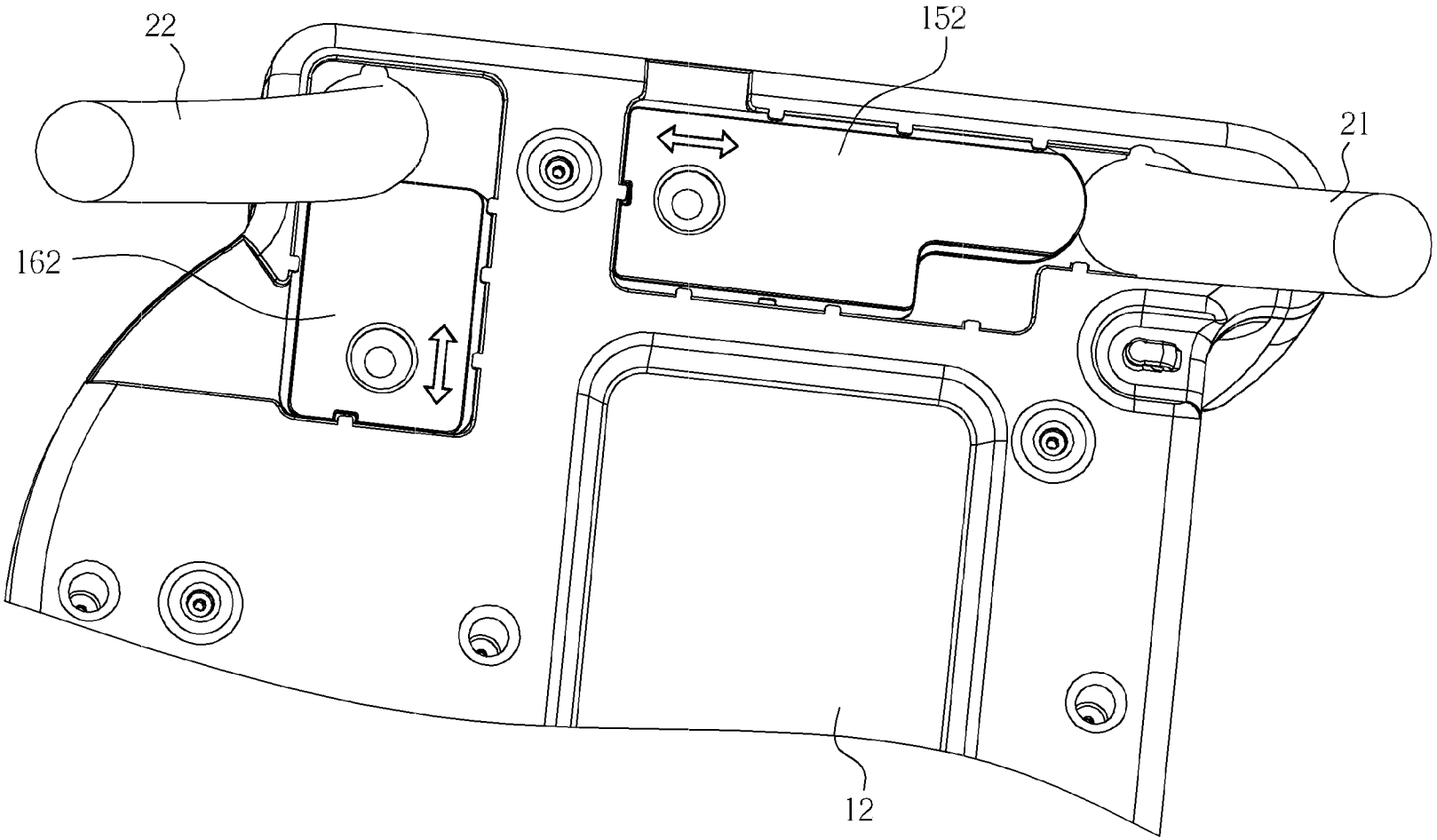
FIG. 8 is a schematic diagram that two of the legs are coupled with the seat in FIG. 7.

To such descriptive purpose, the covers 151, 161 in FIG. 7 are illustrated in the opened position while the covers 152, 162 are illustrated in the closed position. Practically, as the covers 151, 152, 161, 162 are configured in the closed position, each strap of the safety belt set 17 is stored in each corresponding storage 121 and each opening 144 adjacent to the storage 121 is exposed such that the front legs 21 and the rear legs 22 of the supporting frame 20 may respectively couple with the corresponding opening 144 of the coupling section 14. The seat 10 that incorporates with the supporting frame 20 may serve as a high chair. FIG. 8 shows a schematic diagram that two of the legs 21, 22 are coupled with the seat 10. At such configuration, the safety belt set 17 is unused and is stored within the storages 121 of the seat 10 with the covers 152, 162 covering over the storages 121, not only saving room but also preventing possible risk caused by the exposed strap. If the supporting frame 20 is detached from the seat 10, the covers 151, 152, 161, 162 may respectively be configured to the opened position and cover each corresponding opening 144 of the coupling section 14. At such configuration, the supporting frame 20 is not permitted to be mounted to each corresponding opening 144 and each strap of the safety belt set 17 may reach outward from corresponding storage 121. The seat 10 may be placed on the adult chair 2 and secured thereon via buckling of the straps with each other (the buckles of the safety belt set 17 are not shown in the figure). Therefore, the child chair 1 disclosed in this embodiment has design of incorporating the detachability of the supporting frame 20 and storage of the safety belt set 17, assuring the child chair 1 to be used as a high chair only when the safety belt set 17 is completely stored before the supporting frame 20 can be assembled. The safety belt set 17 may be exposed and reach outward only after the supporting frame 20 is detached from the seat 10 and the covers 151, 152, 161, 162 move to uncover the storages 121.

Figure 10:
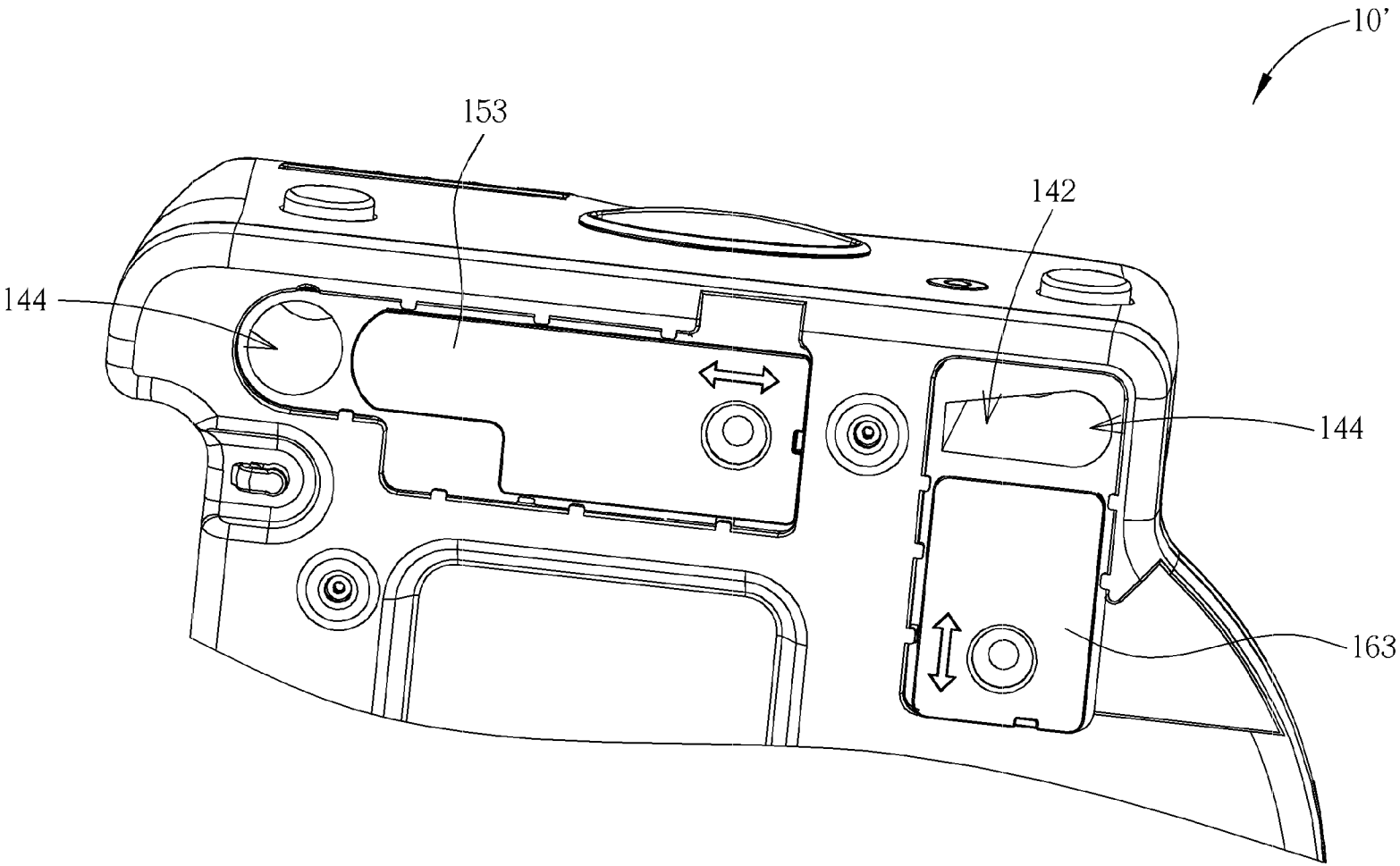
FIG. 10 is a schematic diagram of the bottom of a seat according to the second embodiment.
Figure 11:
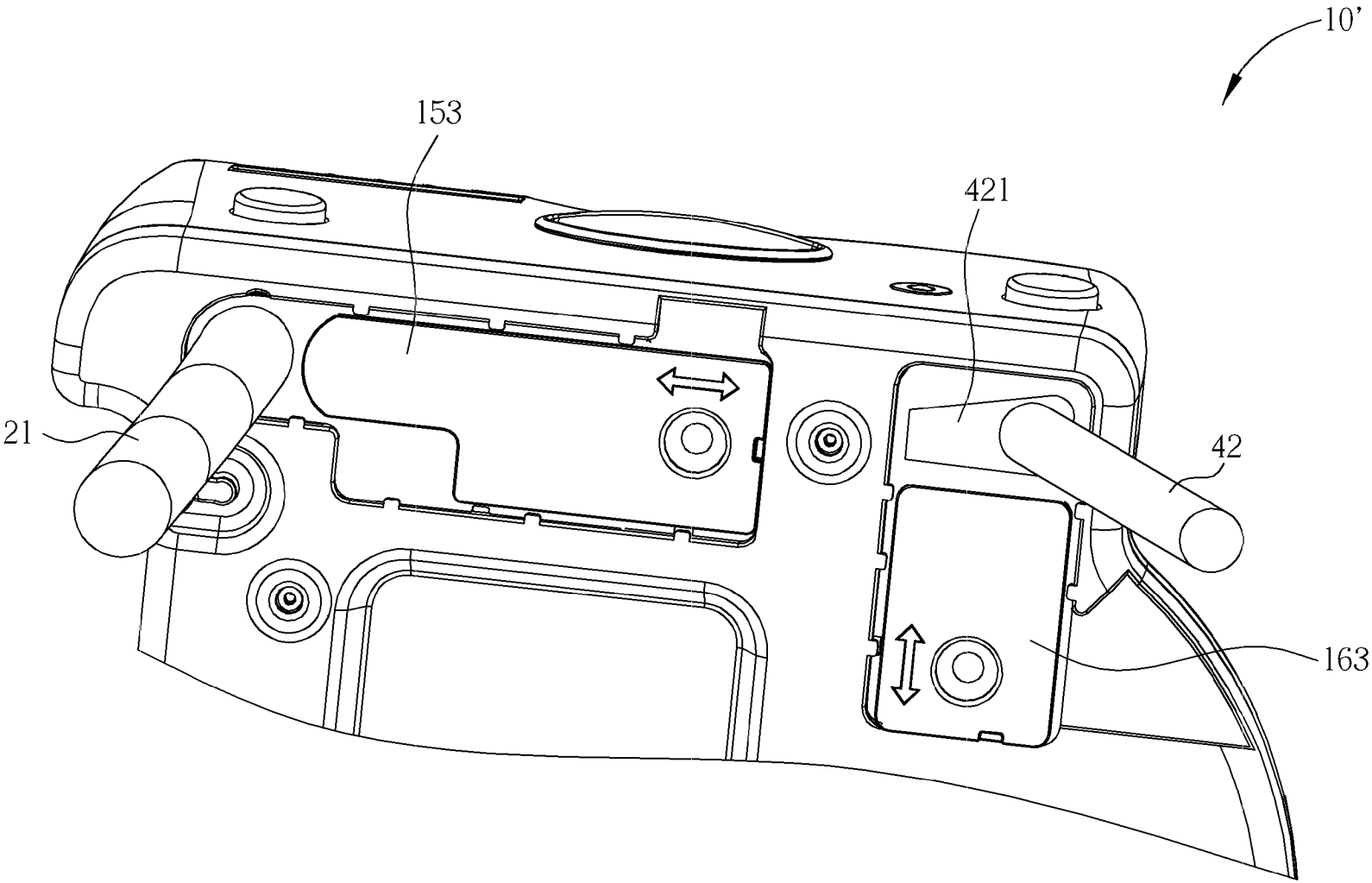
FIG. 11 is a schematic diagram where the legs are engaged with the seat in FIG. 10.

Please refer to FIG. 9 to FIG. 11 for a second embodiment of the child chair of the invention. FIG. 9 shows a schematic diagram of the two rear legs 42 coupling with the footrest 30, FIG. 10 shows a schematic diagram of the bottom of a seat 10', and FIG. 11 shows a schematic diagram where the legs 21, 42 have engagement with the seat 10'. In the second embodiment, each rear leg 42 has a lump 421 at the top end and the opening 144 of the coupling section 14 that corresponds to the rear leg 42 forms a groove 142 with shape matching the lump 421. When the rear leg 42 is coupled with the corresponding opening 144 of the coupling section 14, the lump 421 fits into the groove 142 such that the rear leg 42 may be coupled with the opening 144 of the coupling section 14 in a tilting angle, having similar effect as the rear leg 22 in the first embodiment. The rear legs 42 then extend outward relative to the seat 10', providing stronger support for the seat 10'. Additionally, the lump-and-groove cooperation may also be deployed at the front legs 21. The configuration and mechanism of the covers 153, 163 are same as the covers 151, 152, 161, 162 in the first embodiment, the coupling and operation between the legs 21, 42 and the seat 10', and the design of the straps of the seat 10' are also same as those in the first embodiment, so the description is omitted here for brevity purpose.

The child chair disclosed in the invention has detachable supporting frame. When the supporting frame is assembled to the seat, the child chair is used as a high chair. When the supporting frame is detached from the seat, the child chair may be served as a booster by placing and securing to an adult chair. The seat includes storages with straps connected. Each storage is covered with a cover selectively configured between a closed position and an opened position. When the supporting frame is detached from the seat, the covers may be moved to the opened position, covering the coupling sections of the seat so that the supporting frame is not permitted to assemble to the seat; the straps are reachable outward the storages to secure the seat to the adult chair. When the straps are stored in the storages, the covers may be moved to the closed position, covering the storages and the coupling sections are exposed. The supporting frame is then permitted to assemble to the seat and the child chair may function as the high chair.

Those skilled in the art will readily observe that numerous modifications and alterations of the device and method may be made while retaining the teachings of the invention.

What is claimed is:

1. A child chair comprising:

a seat comprising a coupling section having a plurality of openings, and comprising an operating component configured near one of the openings;

a supporting frame for detachably coupling with the seat, the supporting frame comprising a fastening component for coupling with the coupling section so as to secure the supporting frame at the seat, the operating component utilized for operating the fastening component to disengage the supporting frame from the coupling section; and a strap connecting to the seat;

wherein the child chair is convertible between a high chair status in which the supporting frame is coupled to the seat and a booster status in which the supporting frame is detached from the seat and the strap secures the seat to an adult chair.

2. The child chair of claim 1, wherein the coupling section is located at the bottom of the seat for detachably coupling with the supporting frame.

3. The child chair of claim 1, wherein the fastening component is a V-shape resilient piece.

4. The child chair of claim 1, wherein the supporting frame comprises a lump and the seat comprises a groove cooperating with the lump such that the supporting frame couples with the seat in a tilting angle relative to the seat.

5. The child chair of claim 1, wherein the supporting frame comprises a bending section such that the supporting frame couples with the coupling section in a tilting angle relative to the seat.

6. The child chair of claim 1, wherein the seat further comprises a storage and the strap connects to the storage.

7. The child chair of claim 6, wherein the seat comprises a cover moveable relative to the storage between a closed position where the strap is stored within the storage; and an opened position where the cover covers the coupling section and the strap is reachable outward from the storage.

8. The child chair of claim 1, wherein the supporting frame comprises a plurality of legs, each for coupling with a corresponding opening coupling section.

9. The child chair of claim 8 further comprising a footrest, wherein the plurality of legs comprises two front legs and two rear legs and the footrest is mounted on the two front legs.

10. The child chair of claim 9, wherein the footrest comprises a mounting section for coupling with the two rear legs when the supporting frame is detached from the seat.

11. The child chair of claim 8, wherein the plurality of legs are pipes, the fastening component located in one of the legs for coupling with the coupling section so as to secure the leg at the seat.

12. The child chair of claim 11, wherein each leg comprises a first hole at its wall and the coupling section comprises a second hole at the wall defining one of the openings, and the fastening component comprises a protrusion for extending through the first hole and the second hole to couple the supporting frame with the corresponding opening of the coupling section.

13. A child chair, comprising:

a seat comprising a coupling section having a plurality of openings;

a strap connecting to the seat; and a supporting frame comprising a plurality of legs, each of the openings coupling with a corresponding leg, where each of the legs is coupled with the seat in a tilting angle relative to the seat;

wherein the child chair is convertible between a high chair status in which the supporting frame is coupled to the seat, and a booster status in which the supporting frame is detached from the seat and the strap secures the seat to an adult chair.

14. A booster, capable of assembling to a plurality of legs to form a high chair, the booster comprising:

a seat comprising a plurality of coupling sections and a plurality of storage sections, the coupling sections capable of detachably coupling with the plurality of legs;

a strap connecting to one of the storage sections and stored within the storage section; and a plurality of covers moveably configured at the bottom of the seat, each cover operatively configured over a coupling section or a storage section for each selectively covering the coupling section or the storage section.

15. The booster of claim 14, further comprising an operating component configured near one of the coupling sections and being operated to disengage one of the plurality of legs from the coupling section.

16. The booster of claim 14, wherein the seat comprises a body and a base fixing to the bottom of the body, the plurality of covers moveably configured at the base.

17. The booster of claim 14, wherein each coupling section comprises an opening for coupling with one of the plurality of legs respectively.

18. The booster of claim 17, wherein a groove is formed on each opening of the coupling section for cooperating with a lump of a supporting frame.

19. A child chair comprising:

a seat comprising a coupling section, a storage configured near the coupling section, and a movable cover;

a supporting frame for detachably coupling with the coupling section; and a strap connected to the storage;

wherein the cover is moveable between a first position and a second position; when the cover moves to the first position, the cover covers the storage and the coupling section is uncovered for coupling with the supporting frame and the child chair is configured at a high chair status; when the cover moves to the second position, the cover covers the coupling section and the storage is uncovered and the strap is reachable outward the storage, and the child chair is configured at a booster status.

20. The child chair of claim 19, wherein the supporting frame comprises a plurality of legs, and the coupling section comprises a plurality of openings, each for coupling with one of the legs.

21. The child chair of claim 20, wherein the coupling section is located at the bottom of the seat.

* * * * *